US011842676B2

(12) United States Patent
Liu et al.

(10) Patent No.: US 11,842,676 B2
(45) Date of Patent: Dec. 12, 2023

(54) ELECTRONIC DEVICE

(71) Applicant: Innolux Corporation, Miaoli County (TW)

(72) Inventors: Yong-Zhi Liu, Miaoli County (TW); Ming-Chun Tseng, Miaoli County (TW); Kung-Chen Kuo, Miaoli County (TW); Lien-Hsiang Chen, Miaoli County (TW); Po-Syun Chen, Miaoli County (TW)

(73) Assignee: Innolux Corporation, Miaoli County (TW)

( * ) Notice: Subject to any disclaimer, the term of this patent is extended or adjusted under 35 U.S.C. 154(b) by 0 days.

(21) Appl. No.: 17/985,924

(22) Filed: Nov. 14, 2022

(65) Prior Publication Data

US 2023/0186834 A1 Jun. 15, 2023

Related U.S. Application Data

(60) Provisional application No. 63/289,116, filed on Dec. 13, 2021.

(30) Foreign Application Priority Data

Aug. 24, 2022 (CN) ..... 202211024334.3

(51) Int. Cl.
*G09G 3/32* (2016.01)

(52) U.S. Cl.
CPC ..... *G09G 3/32* (2013.01); *G09G 2300/0842* (2013.01); *G09G 2310/0267* (2013.01); *G09G 2310/061* (2013.01); *G09G 2310/08* (2013.01)

(58) Field of Classification Search
None
See application file for complete search history.

(56) References Cited

U.S. PATENT DOCUMENTS

2019/0108778 A1* 4/2019 Lee ..... G09G 3/006
2019/0279585 A1* 9/2019 Suzuki ..... G02F 1/13306
2022/0392399 A1* 12/2022 Tseng ..... G09G 3/32

* cited by examiner

*Primary Examiner* — Ifedayo B Iluyomade
(74) *Attorney, Agent, or Firm* — JCIPRNET

(57) ABSTRACT

An electronic device is provided. The electronic device includes a detection circuit. The detection circuit includes a programming detection circuit, a light-emitting detection circuit and a determining circuit. The programming detection circuit receives a scan signal, a reset signal and a light-emitting enable signal for a driving circuit of a pixel unit, and provides a first detection signal in a first stage according to the scan signal, the reset signal and the light-emitting enable signal. The light-emitting detection circuit receives the scan signal, the reset signal and the light-emitting enable signal, and provides a second detection signal in a second stage according to the scan signal, the reset signal and the light-emitting enable signal. The determining circuit determines whether to output the light-emitting enable signal to the driving circuit according to the first detection signal and the second detection signal.

20 Claims, 11 Drawing Sheets

ELECTRONIC DEVICE

CROSS-REFERENCE TO RELATED APPLICATION

This application claims the priority benefit of U.S. provisional application Ser. No. 63/289,116, filed on Dec. 13, 2021, and China application serial no. 202211024334.3, filed on Aug. 24, 2022. The entirety of each of the above-mentioned patent applications is hereby incorporated by reference herein and made a part of this specification.

BACKGROUND

Field of the Disclosure

The present disclosure relates to an electronic device, and more particularly, to an electronic device capable of detecting signals.

Description of Related Art

In general, existing devices (e.g., display devices) receive at least one signal and operate to provide a desired function corresponding to the at least one signal. However, when the waveform or timing of the at least one signal is abnormal, the device may malfunction and cannot provide the desired function. Therefore, in order to reduce malfunction of the device, the at least one signal needs to be detected in real time.

SUMMARY OF THE DISCLOSURE

The present disclosure is related to an electronic device capable of detecting signals.

In an embodiment of the disclosure, an electronic device includes a detection circuit. The detection circuit includes a programming detection circuit, a light-emitting detection circuit and a determining circuit. The programming detection circuit receives a scan signal, a reset signal and a light-emitting enable signal for a driving circuit, and provides a first detection signal in a first stage according to the scan signal, the reset signal and the light-emitting enable signal. The light-emitting detection circuit receives the scan signal, the reset signal and the light-emitting enable signal, and provides a second detection signal in a second stage according to the scan signal, the reset signal and the light-emitting enable signal. The determining circuit is coupled to the programming detection circuit and the light-emitting detection circuit. The determining circuit determines whether to output the light-emitting enable signal to the driving circuit according to the first detection signal and the second detection signal.

In an embodiment of the present disclosure, the electronic device includes a detection circuit. The detection circuit includes a driving detection circuit, a determining circuit, and a correction circuit. The driving detection circuit receives the scan signal and the light-emitting enable signal for the driving circuit, and provides the driving detection signal according to the scan signal and the light-emitting enable signal. The determining circuit is coupled to the driving detection circuit. The determining circuit determines whether to output the scan signal and the light-emitting enable signal to the next-stage driving circuit according to the driving detection signal. The correction circuit is coupled to the determining circuit. The correction circuit corrects the level of the output of the determining circuit according to the scan signal and the light-emitting enable signal.

Based on the above, the detection circuit detects a plurality of signals to provide at least one detection signal, and determines whether to output the signal to the driving circuit according to the at least one detection signal. In this way, the detection circuit of the present disclosure may determine whether the plurality of signals are abnormal according to the at least one detection signal, and stop outputting the plurality of signals to the driving circuit accordingly.

DESCRIPTION OF EMBODIMENTS

Figure 1:
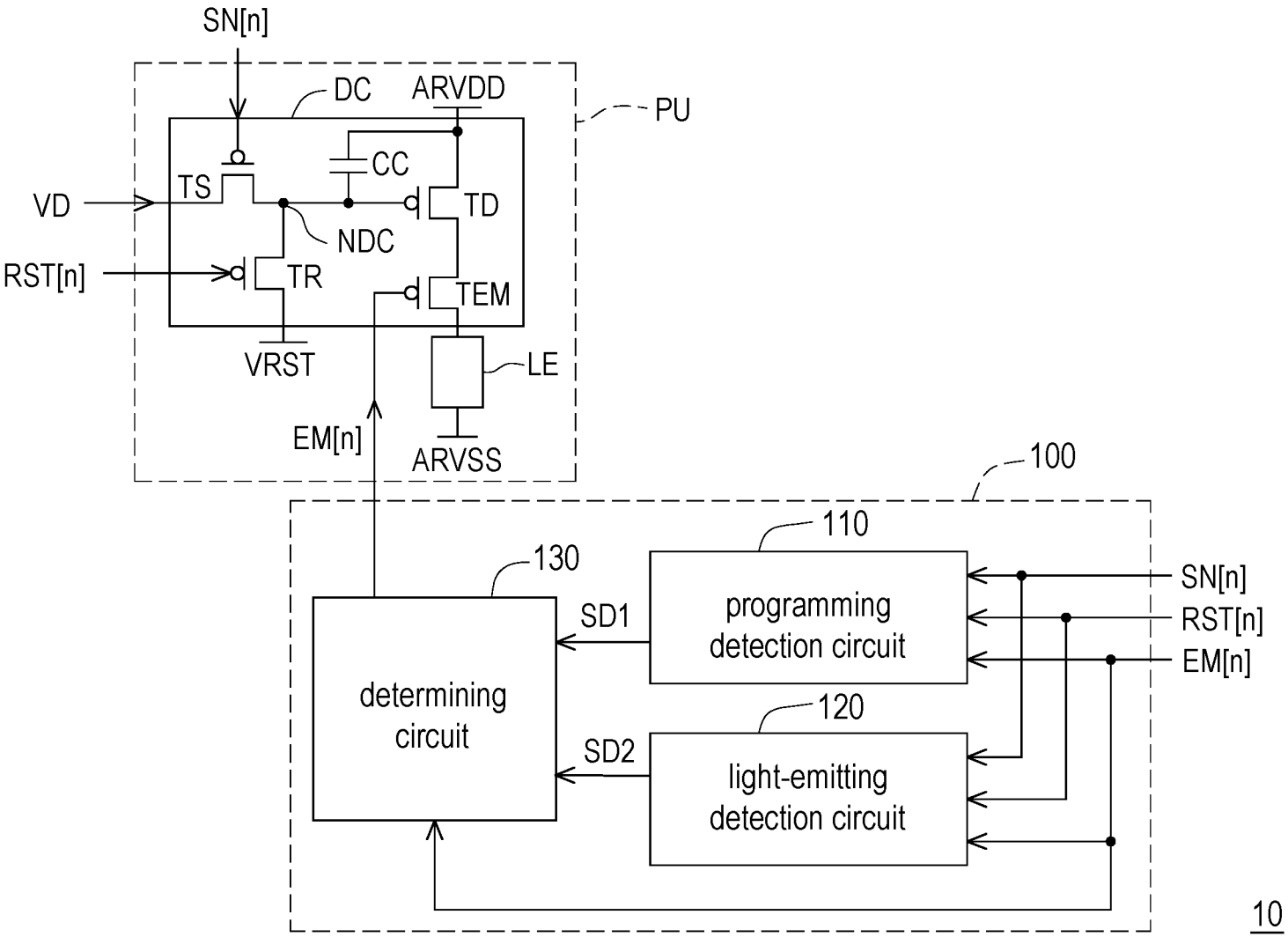
FIG. 1 is a schematic diagram of an electronic device according to a first embodiment of the present disclosure.

The disclosure can be understood by referring to the following detailed description in combination with the accompanying drawings. It should be noted that in order to make it easy for the reader to understand and for the simplicity of the drawings, the multiple drawings in this disclosure only depict a part of the electronic device, and the specific components in the drawings are not drawn according to actual scale. In addition, the number and size of each component in the drawings are only for exemplary purpose, and are not intended to limit the scope of the disclosure.

Certain terms are used throughout the description and the following claims to refer to specific components. As will be understood by those skilled in the art, electronic device manufacturers may refer to components by different names. The disclosure does not intend to distinguish between components that differ by name but not function. In the following description and in the claims, the terms "comprising," "including," and "having" are used in an open-ended fashion, and should therefore be interpreted to mean "including but not limited to . . . ". When the terms "comprising", "including" and/or "having" are used in the description of the disclosure, it will indicate the existence of corresponding features, regions, steps, operations and/or components, but not limited to the existence of one or more corresponding features, regions, steps, operations and/or components.

It will be understood that when a component is referred to as being "coupled", "connected" or "conducting" with another component, the component may be directly connected to the other component and an electrical connection may be made directly, or there may be intermediate components between these components for relaying electrical connections (indirect electrical connections). In contrast, when a component is referred to as being "directly coupled," "directly conducting," or "directly connected" to another component, there are no intermediate components present.

Although the terms "first", "second", "third" . . . may be used to describe various constituent components, the constituent components are not limited by the terms. This term is only used to distinguish a single constituent component from other constituent components in the specification. The same terms may not be used in the claims, but replaced by first, second, third, . . . in the order in which the components are recited in the claims. Therefore, in the following description, the first constituent component may be the second constituent component in the claims.

The electronic device of the present disclosure may include, but is not limited to, an antenna, displaying, light-emitting, sensing, touch, splicing, packaging, other suitable functions, or a combination of the above functions. The electronic device includes a bendable or flexible electronic device, but not limited thereto. The electronic device may include, for example, liquid crystal, light-emitting diode (LED), quantum dot (QD), fluorescence, phosphor, package components, other suitable materials or a combination of the above. An electronic device may, for example, include electronic components, which may include passive components and active components, such as capacitors, resistors, inductors, diodes, transistors, circuit boards, chips, dies, integrated circuits (ICs), packaged components or a combination of the above components or other suitable electronic components, the disclosure is not limited thereto. The diodes may include light-emitting diodes, photodiodes, or antenna diodes, the disclosure is not limited thereto. The light-emitting diodes may, for example, include organic light-emitting diodes (OLEDs), sub-millimeter light-emitting diodes (mini LEDs), micro light-emitting diodes (micro LEDs), or quantum dot LED (which may include QLEDs, QDLEDs), or other suitable materials, or a combination of the above, and the disclosure is not limited thereto. The packaging components may include, for example, a redistribution layer, wafer level packaging (WLP), panel level packaging (PLP) and other packaging components, and the disclosure is not limited thereto. The sensing device may include a camera, an infrared sensor, or a fingerprint sensor, etc., and the present disclosure is not limited thereto. In some embodiments, the sensing device may further include a flash light, an infrared (IR) light source, other sensors, electronic components, or a combination of the above, and the disclosure is not limited thereto. The shape of the electronic device may be rectangular, circular, polygonal, a shape with curved edges, or other suitable shapes. The electronic device may have peripheral systems such as a driving system, a control system, a light source system, etc. to support a display device, an antenna device or a splicing device, and the present disclosure is not limited thereto. In this disclosure, embodiments use a "pixel" or "pixel unit" as a unit for describing a specific region containing at least one functional circuit for at least one specific function. The region of a "pixel" depends on the unit used to provide a particular function, and adjacent pixels may share the same portion or wire, but may also include specific portions of themselves therein. For example, adjacent pixels may share the same scan lines or the same data lines, but the pixels may also have their own transistors or capacitors.

It should be noted that technical features in different embodiments described below may be replaced, recombined or mixed with each other to constitute another embodiment without departing from the spirit of the present disclosure.

Please refer to FIG. 1, which is a schematic diagram of an electronic device according to a first embodiment of the present disclosure. In this embodiment, the electronic device 10 includes a pixel circuit PU and a detection circuit 100. The pixel circuit PU includes a driving circuit DC and a light-emitting element LE. The detection circuit 100 includes a programming detection circuit 110, a light-emitting detection circuit 120 and a determining circuit 130. The programming detection circuit 110 receives a scan signal SN[n], a reset signal RST[n] and a light-emitting enable signal EM[n] for the driving circuit DC. The programming detection circuit 110 provides the first detection signal SD1 in the first stage according to the scan signal SN[n], the reset signal RST[n] and the light-emitting enable signal EM[n]. The light-emitting detection circuit 120 receives the scan signal SN[n], the reset signal RST[n] and the light-emitting enable signal EM[n]. The light-emitting detection circuit 120 provides the second detection signal SD2 in the second stage according to the scan signal SN[n], the reset signal RST[n] and the light-emitting enable signal EM[n].

In this embodiment, the determining circuit 130 is coupled to the programming detection circuit 110 and the light-emitting detection circuit 120. The determining circuit 130 determines whether to output the light-emitting enable signal EM[n] to the driving circuit DC according to the first detection signal SD1 and the second detection signal SD2.

The determining circuit 130 determines whether an abnormality occurs in the first stage and the second stage according to the first detection signal SD1 and the second detection signal SD2. When it is determined that an abnormality occurs in at least one of the first stage and the second stage, the determining circuit 130 stops outputting the light-emitting enable signal EM[n] to the driving circuit DC. On the other hand, when it is determined that the abnormality does not occur in the first stage and the second stage, the determining circuit 130 outputs the light-emitting enable signal EM[n] to the driving circuit DC. For example, when the first detection signal SD1 indicates an abnormality, the determining circuit 130 will learn that one of the scan signal SN[n], the reset signal RST[n] and the light-emitting enable signal EM[n] is abnormal in the first stage. Therefore, the determining circuit 130 stops outputting the light-emitting enable signal EM[n] to the driving circuit DC. When the second detection signal SD2 indicates an abnormality, the determining circuit 130 will learn that one of the scan signal SN[n], the reset signal RST[n] and the light-emitting enable signal EM[n] is abnormal in the second stage. Therefore, the determining circuit 130 stops outputting the light-emitting enable signal EM[n] to the driving circuit DC. When neither the first detection signal SD1 nor the second detection signal SD2 indicates abnormality, the determining circuit 130 learns that the abnormality does not occur in the scan signal SN[n], the reset signal RST[n] and the light-emitting enable signal EM[n]. Therefore, the determining circuit 130 outputs the light-emitting enable signal EM[n] to the driving circuit DC.

It should be noted here that the detection circuit 100 detects the scan signal SN[n], the reset signal RST[n] and the light-emitting enable signal EM[n] to provide the first detection signal SD1 and the second detection signal SD1, and determine whether to output the light-emitting enable signal EM[n] to the driving circuit DC according to the first detection signal SD1 and the second detection signal SD2.

In this way, the detection circuit 100 may determine whether the scan signal SN[n], the reset signal RST[n] and the light-emitting enable signal EM[n] are abnormal according to the first detection signal SD1 and the second detection signal SD2, and stop outputting the light-emitting enable signal EM[n] to the driving circuit DC accordingly.

In this embodiment, the detection circuit 100 may be applied to a display device, for example. The driving circuit DC is, for example, a pixel driving circuit disposed in the pixel unit PU (the disclosure is not limited thereto). In this embodiment, the driving circuit DC may use the scan signal SN[n], the reset signal RST[n] and the light-emitting enable signal EM[n] to drive the light-emitting element LE disposed in the pixel unit PU. The light-emitting element LE may be at least one light-emitting diode or other suitable electronic components. Taking this embodiment as an example, the driving circuit DC includes a scan transistor TS, a reset transistor TR, a driving transistor TD, an enable transistor TEM, and a capacitor CC. The first terminal of the scan transistor TS receives the data signal VD. The second terminal of the scan transistor TS is coupled to the control node NDC. The control terminal of the scan transistor TS receives the scan signal SN[n]. The first terminal of the reset transistor TR is coupled to the control node NDC. The second terminal of the reset transistor TR is coupled to the reset bias voltage VRST. The control terminal of the reset transistor TR receives the reset signal RST[n]. The reset signal RST[n] may be the previous-stage scan signal (e.g., scan signal SN[n−1], the present disclosure is not limited thereto). The first terminal of the driving transistor TD receives the high reference voltage ARVDD. The control terminal of the driving transistor TD is coupled to the control node NDC. The first terminal of the enable transistor TEM is coupled to the second terminal of the driving transistor TD. The control terminal of the enable transistor TEM receives the light-emitting enable signal EM[n] through the determining circuit 130. The first terminal of the light-emitting element LE is coupled to the second terminal of the enable transistor TEM. The second terminal of the light-emitting element LE is coupled to the second terminal of the enable transistor TEM to receive the low reference voltage ARVSS. The capacitor CC is coupled between the first terminal of the driving transistor TD and the control terminal of the driving transistor TD. In this embodiment, the scan transistor TS, the reset transistor TR, the driving transistor TD and the enable transistor TEM are respectively exemplified as P-type transistors, but the present disclosure is not limited thereto. Therefore, in this embodiment, the driving circuit DC operates based on the negative pulses of the scan signal SN[n], the reset signal RST[n] and the light-emitting enable signal EM[n]. The driving circuit DC of this embodiment is implemented by, for example, a structure of 4 transistors and 1 capacitor (4T1C), but the present disclosure is not limited thereto. Circuits capable of driving components based on the scan signal SN[n], the reset signal RST[n], and the light-emitting enable signal EM[n] all belong to the scope of the driving circuit DC of the present disclosure.

In the present embodiment, in an example in which the detection circuit 100 may be applied, for example, to a display device, the first stage is a data input stage for the driving circuit DC. Therefore, the determining circuit 130 may use the first detection signal SD1 to determine whether the scan signal SN[n], the reset signal RST[n] and the light-emitting enable signal EM[n] in the data input stage are abnormal. Furthermore, the second stage is a light-emitting stage for the driving circuit DC. Therefore, the determining circuit 130 may use the second detection signal SD2 to determine whether the scan signal SN[n], the reset signal RST[n] and the light-emitting enable signal EM[n] in the light-emitting stage are abnormal.

Figure 2A:
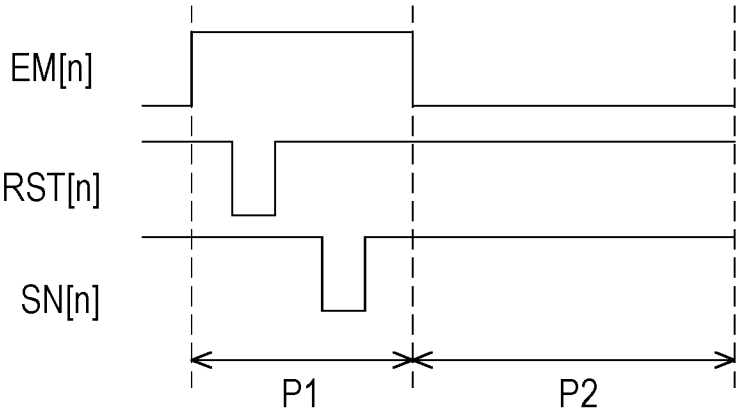
FIG. 2A is a timing diagram of a normal signal according to an embodiment of the present disclosure.

Please refer to FIG. 1 and FIG. 2A at the same time. FIG. 2A is a timing diagram of a normal signal according to an embodiment of the present disclosure. FIG. 2A shows a normal timing diagram of the scan signal SN[n], the reset signal RST[n], and the light-emitting enable signal EM[n]. In the first stage P1, the light-emitting enable signal EM[n] is at high level. The reset signal RST[n] has a negative pulse. The scan signal SN[n] also has a negative pulse. The timing of the negative pulse of the reset signal RST[n] is ahead of the timing of the negative pulse of the scan signal SN[n]. The negative pulse of the reset signal RST[n] and the negative pulse of the scan signal SN[n] do not overlap each other in timing. Therefore, the programming detection circuit 110 provides the first detection signal SD1 with a first level (e.g., a high level) according to the above timing in the first stage P1.

In the second stage P2, the light-emitting enable signal EM[n] is at low level. The reset signal RST[n] and the scan signal SN[n] are respectively at a high level.

Therefore, the light-emitting detection circuit 120 provides the second detection signal SD2 having the first level according to the above timing in the second stage P2.

The determining circuit 130 outputs the light-emitting enable signal EM[n] to the driving circuit DC according to the first detection signal SD1 and the second detection signal SD2 having the first level.

Figure 2B:
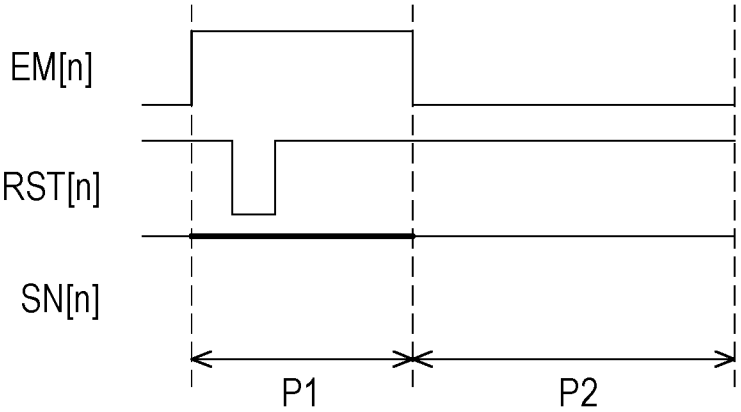
FIG. 2B to FIG. 2D are timing diagrams of abnormal signals according to an embodiment of the present disclosure, respectively.
Figure 2C:
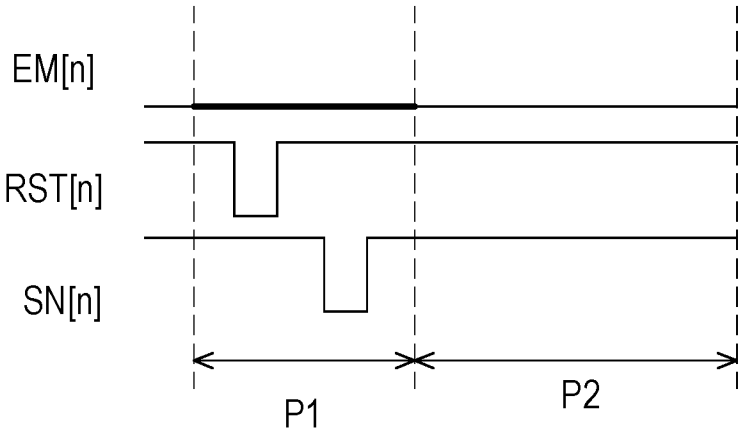
Figure 2D:
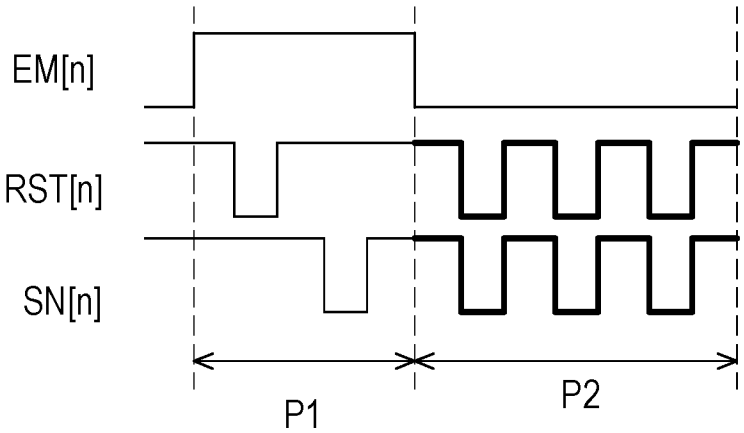

FIG. 2B to FIG. 2D are timing diagrams of abnormal signals according to an embodiment of the present disclosure, respectively. Please refer to FIG. 1 and FIG. 2B at the same time. FIG. 2B shows an abnormal timing diagram of the scan signal SN[n] in the first stage P1. In the first stage P1, the scan signal SN[n] has no negative pulse. Therefore, the programming detection circuit 110 provides the first detection signal SD1 having the second level (e.g., the low level) according to the above-mentioned timing in the first stage P1. The determining circuit 130 stops outputting the light-emitting enable signal EM[n] to the driving circuit DC according to the first detection signal SD1 having the second level.

Please refer to FIG. 1 and FIG. 2C at the same time. FIG. 2C shows an abnormal timing diagram of the light-emitting enable signal EM[n] in the first stage P1. In the first stage P1, when the light-emitting enable signal EM[n] is at a low level, the programming detection circuit 110 also provides the first detection signal SD1 of the second level.

Please refer to FIG. 1 and FIG. 2D at the same time. FIG. 2D shows an abnormal timing diagram of the scan signal SN[n] in the second stage P2. In the second stage P2, the scan signal SN[n] and the reset signal RST[n] have at least one negative pulse. Therefore, the light-emitting detection circuit 120 provides the second detection signal SD2 having the second level according to the above timing in the second stage P2. The determining circuit 130 stops outputting the light-emitting enable signal EM[n] to the driving circuit DC according to the second detection signal SD2 having the second level. In some embodiments, in the second stage P2, when the light-emitting enable signal EM[n] is at a high level, the programming detection circuit 110 also provides a second detection signal SD2 with a second level.

Figure 3:
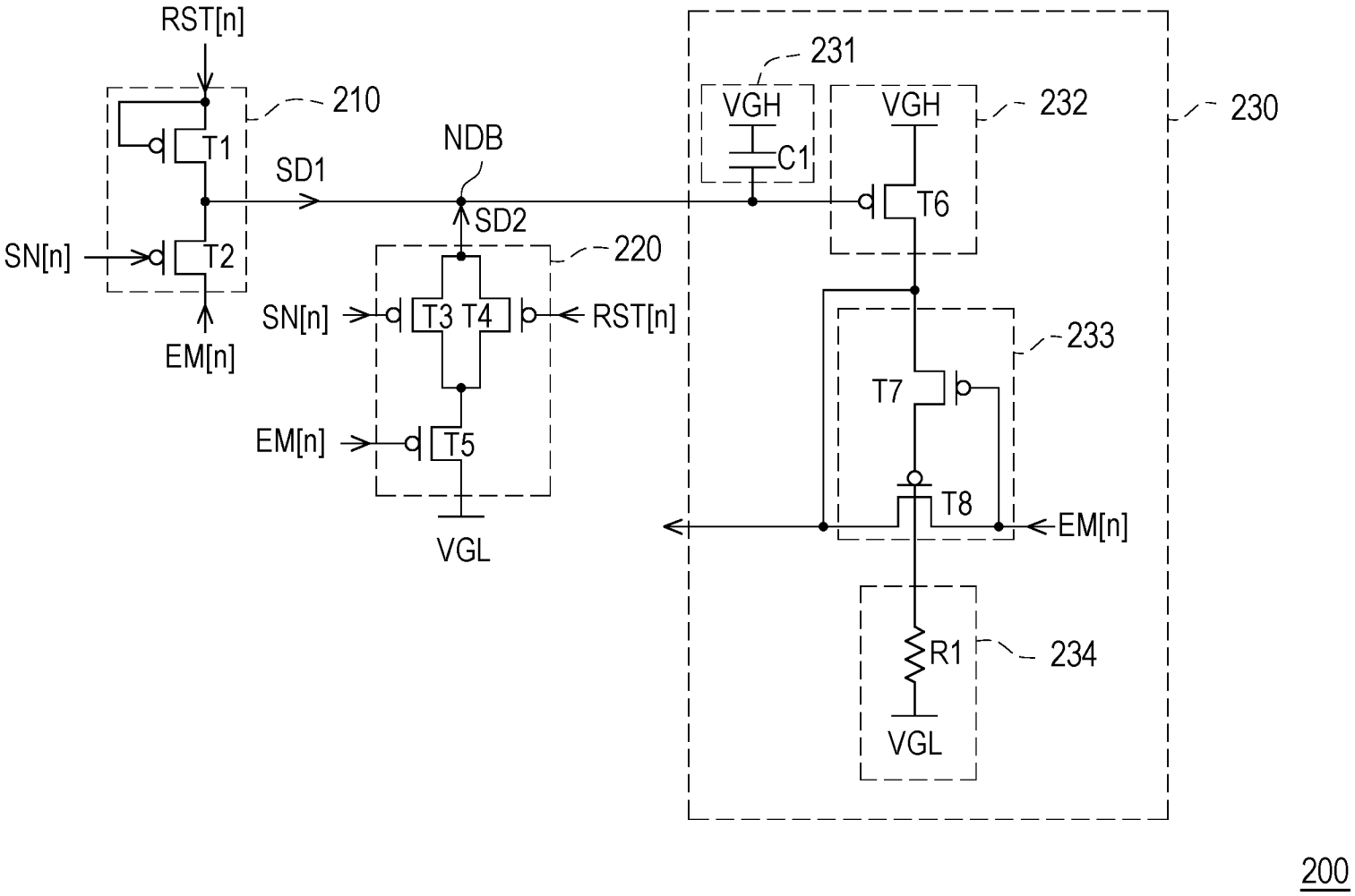
FIG. 3 is a first schematic circuit diagram of the detection circuit according to the first embodiment.

Please refer to FIG. 3, which is a first schematic circuit diagram of the detection circuit according to the first embodiment. In this embodiment, the detection circuit 200 includes a programming detection circuit 210, a light-emitting detection circuit 220 and a determining circuit 230. The programming detection circuit 210 includes a first detection transistor T1 and a second detection transistor T2. The first terminal of the first detection transistor T1 and the control terminal of the first detection transistor T1 receive the reset signal RST[n]. The second terminal of the first detection transistor T1 is coupled to the voltage regulator node NDB. The first terminal of the second detection transistor T2 is coupled to the voltage regulator node NDB. The second terminal of the second detection transistor T2 receives the light-emitting enable signal EM[n]. The control terminal of the second detection transistor T2 receives the scan signal SN[n].

The light-emitting detection circuit 220 includes a third detection transistor T3, a fourth detection transistor T4 and a fifth detection transistor T5. The first terminal of the third detection transistor T3 is coupled to the voltage regulator node NDB. The control terminal of the third detection transistor T3 receives the scan signal SN[n]. The first terminal of the fourth detection transistor T4 is coupled to the voltage regulator node NDB. The control terminal of the fourth detection transistor T4 receives the reset signal RST [n]. The first terminal of the fifth detection transistor T5 is coupled to the second terminal of the third detection transistor T3 and the second terminal of the fourth detection transistor T4. The second terminal of the fifth detection transistor T5 is coupled to the low voltage VGL. The control terminal of the fifth detection transistor T5 receives the light-emitting enable signal EM[n].

The determining circuit 230 includes a voltage regulator circuit 231, a pull-up circuit 232, a transmitting circuit 233, and a pull-down circuit 234. The voltage regulator circuit 231 is coupled to the voltage regulator node NDB. The voltage regulator circuit 231 provides regulated voltage to the voltage regulator node NDB. The pull-up circuit 232 is coupled to the voltage regulator node NDB. The transmitting circuit 233 is coupled to the pull-up circuit 232. The pull-down circuit 234 is coupled to the transmitting circuit 233. In this embodiment, the pull-up circuit 232 is disabled in response to the first level (such as a high level) at the voltage regulator node NDB, so that the transmitting circuit 233 is turned on by the pull-down circuit 234 and outputs the light-emitting enable signal EM[n] to the driving circuit DC. The pull-up circuit 232 is enabled in response to the second level (e.g., low level) at the voltage regulator node NDB, so that the transmitting circuit 233 is turned off and stops outputting the light-emitting enable signal EM[n] to the driving circuit DC.

In this embodiment, the voltage regulator circuit 231 includes a capacitor C1. The capacitor C1 is coupled between the high voltage VGH and the voltage regulator node NDB. The voltage regulator circuit 231 may provide a bias voltage to the voltage regulator node NDB by using the high voltage VGH. The pull-up circuit 232 includes a transistor T6. The first terminal of the transistor T6 is coupled to the high voltage VGH. The second terminal of the transistor T6 is coupled to the transmitting circuit 233. The control terminal of the transistor T6 is coupled to the voltage regulator node NDB and the voltage regulator circuit 231. The transmitting circuit 233 includes transistors T7 and T8. The first terminal of the transistor T7 is coupled to the second terminal of the transistor T6. The control terminal of the transistor T7 receives the light-emitting enable signal EM[n]. The first terminal of the transistor T8 is coupled to the control terminal of the transistor T7 to receive the light-emitting enable signal EM[n]. The second terminal of the transistor T8 is coupled to the first terminal of the transistor T7. The second terminal of the transistor T8 serves as the output terminal of the determining circuit 230. The control terminal of the transistor T8 is coupled to the second terminal of the transistor T7. The pull-down circuit 234 includes a resistor R1. The resistor R1 is coupled between the control terminal of the transistor T8 and the low voltage VGL.

In this embodiment, the first detection transistor T1, the second detection transistor T2, the third detection transistor T3, the fourth detection transistor T4, the fifth detection transistor T5, and the transistors T6 to T8 are respectively, for example, exemplified as a P-type transistor. In some embodiments, the first detection transistor T1, the second detection transistor T2, the third detection transistor T3, the fourth detection transistor T4, the fifth detection transistor T5, and the transistors T6 to T8 may also be N-type transistors.

Please refer to FIG. 1, FIG. 2A and FIG. 3 at the same time, in this embodiment, in the first stage P1, based on normal timing of the scan signal SN[n], the reset signal RST[n] and the light-emitting enable signal EM[n], the first detection transistor T1 and the second detection transistor T2 may jointly provide the first detection signal SD1 having the first level (high level) to the voltage regulator node NDB. In addition, in the second stage P2, based on the normal timing of the scan signal SN[n], the reset signal RST[n] and the light-emitting enable signal EM[n], the third detection transistor T3, the fourth detection transistor T4, and the fifth detection transistor T5 may jointly provide the second detection signal SD2 having the first level to the voltage regulator node NDB. Both the first detection signal SD1 and the second detection signal SD2 have a high level. Therefore, the level at the voltage regulator node NDB is maintained at a high level. The transistor T6 will be turned off. The voltage value of the control terminal of the transistor T8 is pulled down to a low level by the pull-down circuit 234. Therefore, the transistor T8 is turned on to output the received light-emitting enable signal EM[n] to the driving circuit DC.

Please refer to FIG. 1, FIG. 2B and FIG. 3 at the same time. In this embodiment, in the first stage P1, based on the abnormal timing of the scan signal SN[n], the first detection transistor T1 and the second detection transistor T2 may jointly provide the first detection signal SD1 having the second level (low level) to pull down the level at the voltage regulator node NDB. The transistor T6 will be turned on. The transistor T6 adopts the high voltage VGH to set the level of the second terminal of the transistor T8 to a high level. Therefore, the enable transistor TEM of the driving circuit DC stops driving the light-emitting element LE based on the high level at the second terminal of the transistor T8. Furthermore, in the second stage P2, the light-emitting enable signal EM[n] has a low level. The transistor T7 is turned on in response to the light-emitting enable signal EM[n] having a low level. The transistor T6 adopts a high voltage VGH to turn off the transistor T8. Therefore, the light-emitting enable signal EM[n] having a low level is turned on and not output to the driving circuit DC.

Please refer to FIG. 1, FIG. 2C and FIG. 3 at the same time. In the present embodiment, in the first stage P1, based on the light-emitting enable signal EM[n] having a low level, the first detection transistor T1 and the second detection transistor T2 may jointly provide the first detection signal SD1 with a second level (low level) to pull down the level at the voltage regulator node NDB. The transistor T6 will be turned on. The transistor T7 is turned on in response to the light-emitting enable signal EM[n] having a low level.

The transistor T6 adopts the high voltage VGH to set the level of the second terminal of the transistor T8 and the control terminal of the transistor T8 to a high level. Therefore, the transistor T8 is turned off. In addition, the enable transistor TEM of the driving circuit DC stops driving the light-emitting element LE based on the high level at the second terminal of the transistor T8. In the second stage P2, the light-emitting enable signal EM[n] still has a low level. Therefore, the transistor T8 is still turned off. The light-emitting enable signal EM[n] with a low level is turned on and not output to the driving circuit DC.

Please refer to FIG. 1, FIG. 2D and FIG. 3 at the same time. In this embodiment, in the second stage P2, based on the abnormal timing of the scan signal SN[n] and the reset signal RST[n] having negative pulses, the third detection transistor T3, the fourth detection transistor T4 and the fifth detection transistor T5 may jointly provide the second detection signal SD2 with a second level (low level) to pull down the level at the voltage regulator node NDB. The transistor T6 will be turned on. The transistor T7 is turned on in response to the light-emitting enable signal EM[n] having a low level. The transistor T6 adopts the high voltage VGH to set the level of the second terminal of the transistor T8 and the control terminal of the transistor T8 to a high level. Therefore, the transistor T8 is turned off. In addition, the enable transistor TEM of the driving circuit DC stops driving the light-emitting element LE based on the high level at the second terminal of the transistor T8. In the second stage P2, the light-emitting enable signal EM[n] still has a low level. Therefore, the transistor T8 is still turned off. The light-emitting enable signal EM[n] with a low level is turned on and not output to the driving circuit DC.

Figure 4:
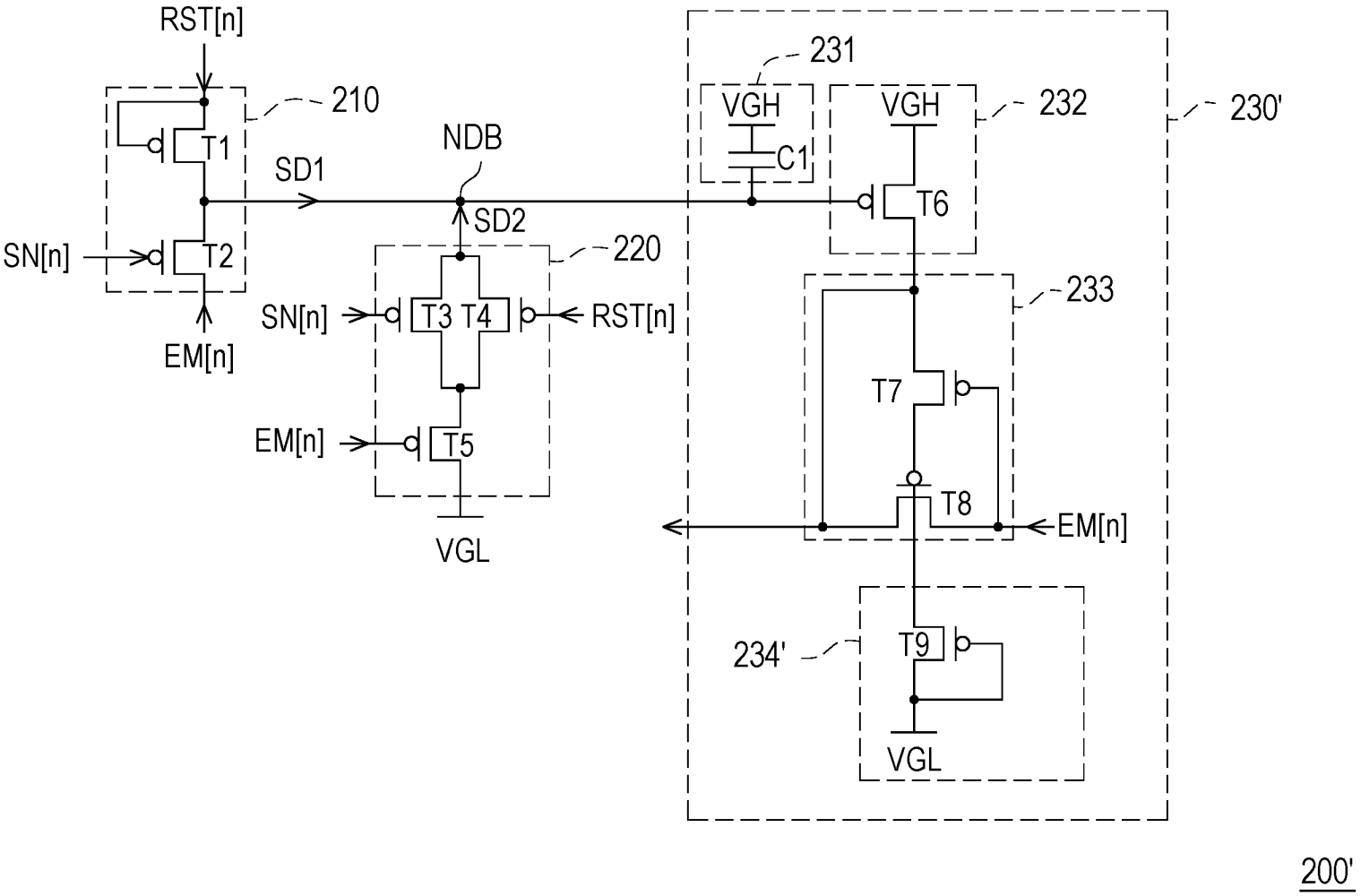
FIG. 4 is a second schematic circuit diagram of the detection circuit according to the first embodiment.

Please refer to FIG. 4, which is a second schematic circuit diagram of the detection circuit according to the first embodiment. In this embodiment, the detection circuit 200' includes a programming detection circuit 210, a light-emitting detection circuit 220 and a determining circuit 230'. The implementations of the programming detection circuit 210 and the light-emitting detection circuit 220 may be derived from the foregoing embodiments, so the details are not repeated here. The determining circuit 230' includes a voltage regulator circuit 231, a pull-up circuit 232, a transmitting circuit 233, and a pull-down circuit 234'. The implementations of the voltage regulator circuit 231, the pull-up circuit 232 and the transmitting circuit 233 may be derived from the foregoing embodiments, so the details are not repeated here. In this embodiment, the pull-down circuit 234' includes a transistor T9. The first terminal of the transistor T9 is coupled to the control terminal of the transistor T8. The second terminal of the transistor T9 and the control terminal of the transistor T9 are coupled to the low voltage VGL. The transistor T9 is adopted to provide an equivalent resistor between the control terminal of the transistor T8 and the low voltage VGL. In this embodiment, the transistor T9 is exemplified as, for example, a P-type transistor, but the present disclosure is not limited thereto.

Figure 5:
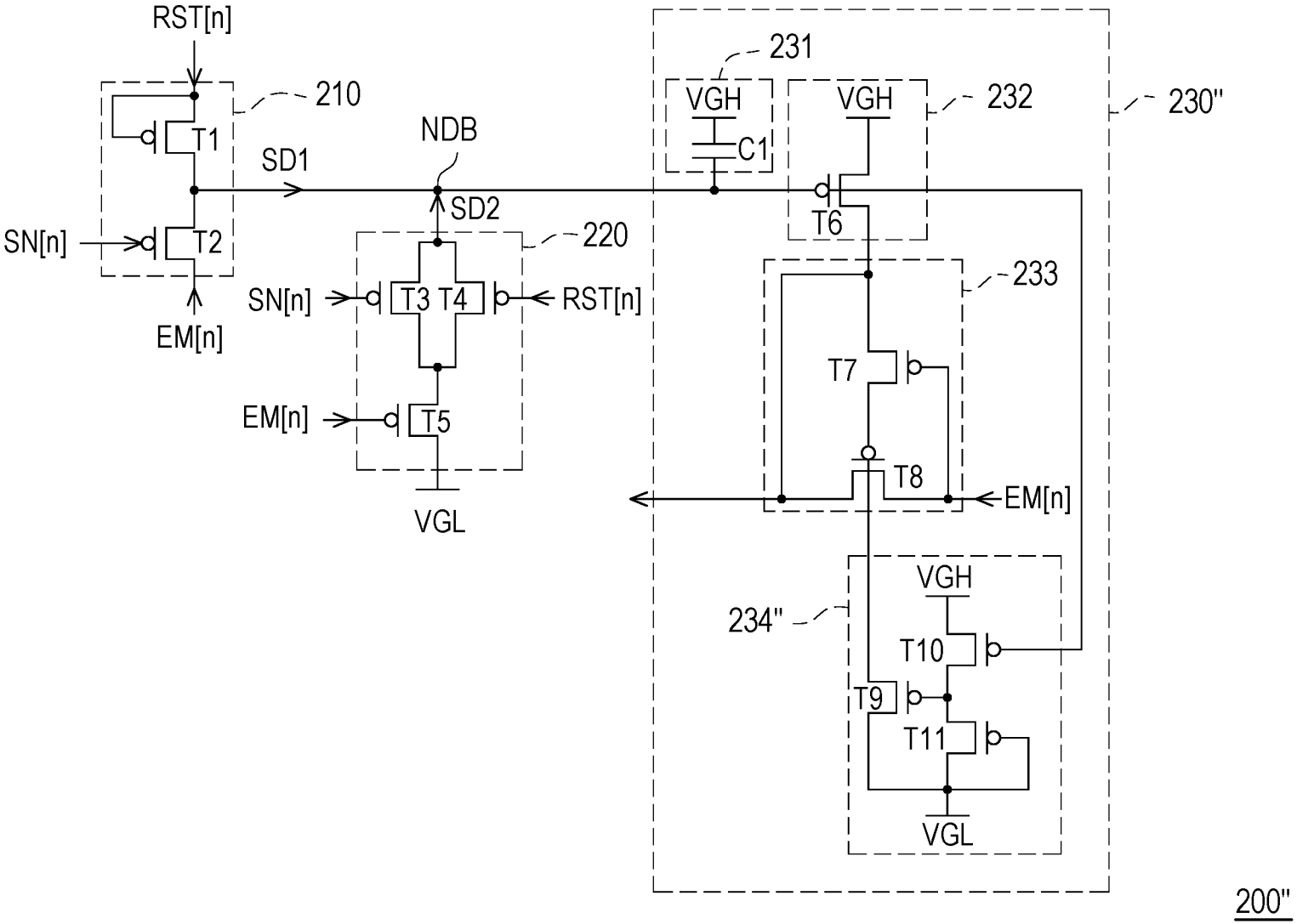
FIG. 5 is a third schematic circuit diagram of the detection circuit according to the first embodiment.

Please refer to FIG. 5, which is a third schematic circuit diagram of the detection circuit according to the first embodiment. In this embodiment, the detection circuit 200" includes a programming detection circuit 210, a light-emitting detection circuit 220, and a determining circuit 230". The implementation of the programming detection circuit 210 and the light-emitting detection circuit 220 may be derived from the above-mentioned embodiments, so the details are not repeated here. The determining circuit 230" includes a voltage regulator circuit 231, a pull-up circuit 232, a transmitting circuit 233, and a pull-down circuit 234". The implementations of the voltage regulator circuit 231, the pull-up circuit 232 and the transmitting circuit 233 may be derived from the aforementioned embodiments, so the details are not be repeated here. In this embodiment, the pull-down circuit 234" includes transistors T9, T10, and T11. The first terminal of the transistor T9 is coupled to the control terminal of the transistor T8. The second terminal of the transistor T9 is coupled to the low voltage VGL. The first terminal of the transistor T10 is coupled to the high voltage VGH. The second terminal of the transistor T10 is coupled to the control terminal of the transistor T9. The control terminal of the transistor T10 is coupled to the voltage regulator node NDB. The first terminal of the transistor T11 is coupled to the second terminal of the transistor T10. The second terminal of the transistor T11 and the control terminal of the transistor T11 are coupled to the low voltage VGL. The transistor T11 is adopted to provide an equivalent resistor between the control terminal of the transistor T9 and the low voltage VGL.

In this embodiment, when at least one of the first detection signal SD1 and the second detection signal SD2 has a low level, the level at the voltage regulator node NDB is a low level. The transistors T6 and T10 are turned on. Therefore, the transistor T6 adopts the high voltage VGH to turn off the transistor T8. Under the circumstances, the transistor T10 turns off the transistor T9 by adopting the high voltage VGH. Therefore, there is no leakage current between the control terminal of the transistor T8 and the low voltage VGL.

When both the first detection signal SD1 and the second detection signal SD2 have a high level, the transistors T6 and T10 are turned off. The transistor T11 pulls down the level of the control terminal of the transistor T9 to a low level. The transistor T9 is turned on. Therefore, the transistor T8 is turned on to transmit the light-emitting enable signal EM[n]. In this embodiment, the transistors T9 to T11 are exemplified as, for example, P-type transistors, respectively, but the present disclosure is not limited thereto.

Figure 6:
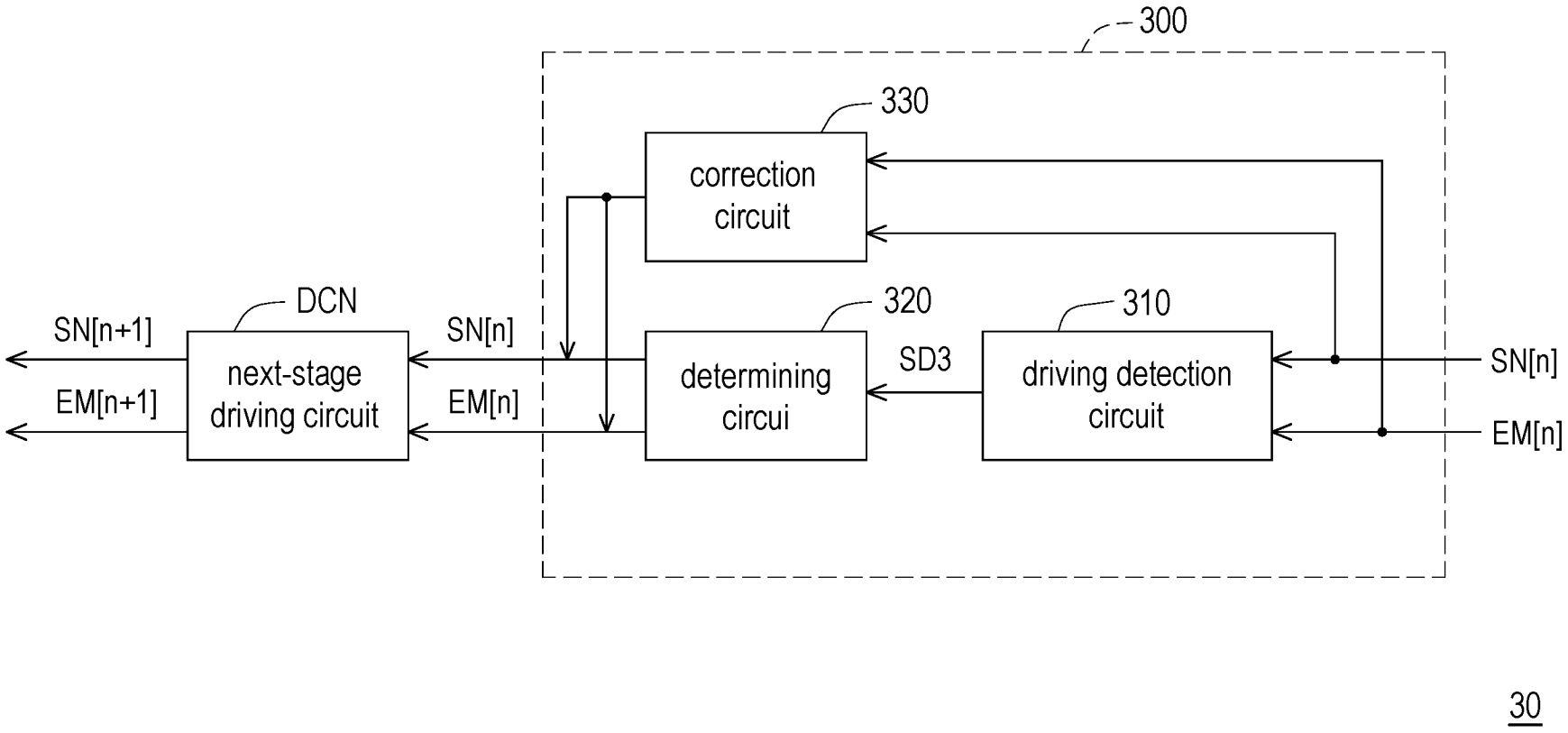
FIG. 6 is a schematic diagram of an electronic device according to a second embodiment of the present disclosure.

Please refer to FIG. 6, which is a schematic diagram of an electronic device according to a second embodiment of the present disclosure. In this embodiment, the electronic device 30 includes a next-stage driving circuit DCN and a detection circuit 300. The detection circuit 300 includes a driving detection circuit 310, a determining circuit 320 and a correction circuit 330. The driving detection circuit 310 receives the scan signal SN[n] and the light-emitting enable signal EM[n] for the driving circuit (e.g., the driving circuit DC shown in FIG. 1). The driving detection circuit 310 provides the driving detection signal SD3 according to the scan signal SN[n] and the light-emitting enable signal EM[n]. The determining circuit 320 is coupled to the driving detection circuit 310. The determining circuit 320 determines whether to output the scan signal SN[n] and the light-emitting enable signal EM[n] to the next-stage driving circuit DCN according to the driving detection signal SD3. The correction circuit 330 is coupled to the determining circuit 320. The correction circuit 330 corrects the level of output of the determining circuit 320 according to the scan signal SN[n] and the light-emitting enable signal EM[n].

In this embodiment, the detection circuit 300 may determine whether the scan signal SN[n] and the light-emitting enable signal EM[n] are abnormal according to the driving detection signal SD3, and stop outputting the light-emitting enable signal EM[n] to the next-stage driving circuit DCN accordingly.

The detection circuit 300 may be applied to a display device, for example. The driving circuit is, for example, a pixel driving circuit disposed in the pixel unit (the disclosure is not limited thereto). The next-stage driving circuit DCN is a gate driving circuit. In this embodiment, the next-stage driving circuit DCN transmits the scan signal SN[n] and the light-emitting enable signal EM[n] through the detection circuit 300. The next-stage driving circuit DCN generates the next-stage scan signal SN[n+1] according to the scan signal SN[n], and generates the next-stage light-emitting enable signal EM[n+1] according to the light-emitting enable signal EM[n].

In this embodiment, the determining circuit 320 determines whether the scan signal SN[n] and the light-emitting enable signal EM[n] are abnormal according to the driving detection signal SD3. When it is determined that an abnormality occurs to at least one of the scan signal SN[n] and the light-emitting enable signal EM[n], the determining circuit 320 stops outputting the scan signal SN[n] and the light-emitting enable signal EM[n] to the next-stage driving circuit DCN. Furthermore, the correction circuit 330 corrects the level of the output of the determining circuit 320. Therefore, the next-stage driving circuit DCN does not generate the next-stage scan signal SN[n+1] and the next-stage light-emitting enable signal EM[n+1].

On the other hand, when it is determined that the abnormality does not occur in the scan signal SN[n] and the light-emitting enable signal EM[n], the determining circuit 320 outputs the scan signal SN[n] and the light-emitting enable signal EM[n] to the next-stage driving circuit DCN. Therefore, the next-stage driving circuit DCN generates the next-stage scan signal SN[n+1] and the next-stage light-emitting enable signal EM[n+1].

Please refer to FIG. 2A and FIG. 6 at the same time. In this embodiment, based on the normal timing of the scan signal SN[n] and the light-emitting enable signal EM[n], the driving detection circuit 310 does not provide the driving detection signal SD3 with a second level (low level). Therefore, the determining circuit 320 outputs the scan signal SN[n] and the light-emitting enable signal EM[n] to the next-stage driving circuit DCN.

Please refer to FIG. 2C, FIG. 2D and FIG. 6 at the same time. In this embodiment, based on the abnormal timing of the scan signal SN[n] and/or the light-emitting enable signal EM[n], the driving detection circuit 310 provides the driving detection signal SD3 with a second level. Therefore, the determining circuit 320 may stop outputting the scan signal SN[n] and the light-emitting enable signal EM[n] to the next-stage driving circuit DCN according to the driving detection signal SD3 having the second level. In addition, the correction circuit 330 corrects the level of the output of the determining circuit 320 according to the abnormal timing of the scan signal SN[n] and/or the light-emitting enable signal EM[n].

Figure 7:
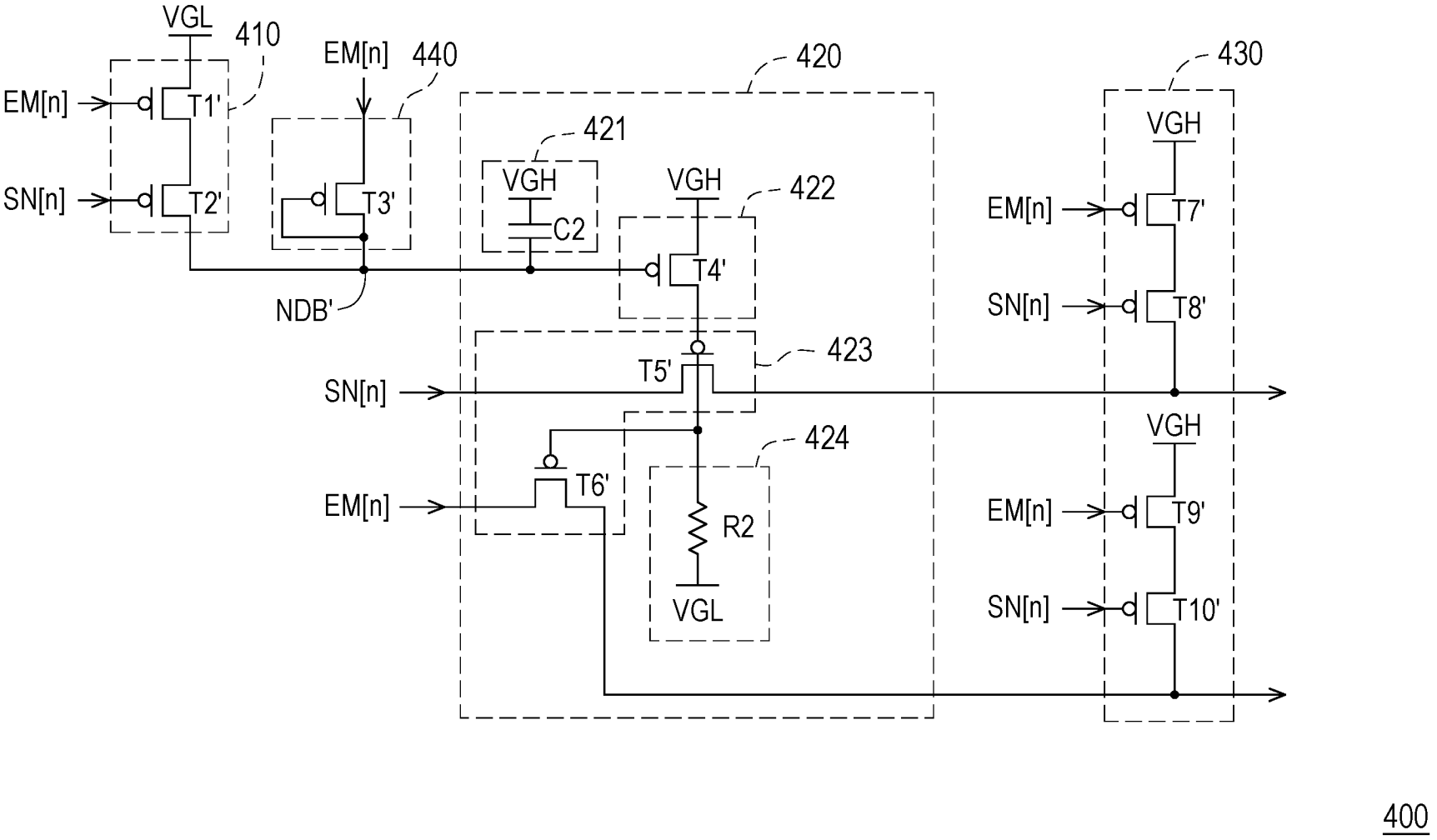
FIG. 7 is a first schematic circuit diagram of the detection circuit according to the second embodiment.

Please refer to FIG. 7. FIG. 7 is a first schematic circuit diagram of the electronic device according to the second embodiment. In this embodiment, the electronic device 400 includes a driving detection circuit 410, a determining circuit 420 and a correction circuit 430. The driving detection circuit 410 includes a first detection transistor T1' and a second detection transistor T2'. The first terminal of the first detection transistor T1' is coupled to the low voltage VGL. The control terminal of the first detection transistor T1' receives the light-emitting enable signal EM[n]. The first terminal of the second detection transistor T2' is coupled to the second terminal of the first detection transistor T1'. The second terminal of the second detection transistor T2' is coupled to the voltage regulator node NDB'. The control terminal of the second detection transistor T2' receives the scan signal SN[n].

The determining circuit 420 includes a voltage regulator circuit 421, a pull-up circuit 422, a transmitting circuit 423, and a pull-down circuit 424. The voltage regulator circuit 421 is coupled to the voltage regulator node NDB'. The voltage regulator circuit 421 provides regulated voltage to the voltage regulator node NDB'. The pull-up circuit 422 is coupled to the voltage regulator node NDB'. The transmitting circuit 423 is coupled to the pull-up circuit 422. The pull-down circuit 424 is coupled to the transmitting circuit 423. In this embodiment, the pull-up circuit 422 is disabled in response to the first level (e.g., the high level) at the voltage regulator node NDB', so that the transmitting circuit 423 is turned on by the pull-down circuit 424 and outputs the scan signal SN[n] and the light-emitting enable signal EM[n] to the next-stage driving circuit DCN. The pull-up circuit 422 is enabled in response to the second level (e.g., low level) at the voltage regulator node NDB', so that the transmitting circuit 423 is turned off and stops outputting the light-emitting enable signal EM[n] to the next-stage driving circuit DCN.

In this embodiment, the voltage regulator circuit 421 includes a capacitor C2. The capacitor C2 is coupled between the high voltage VGH and the voltage regulator node NDB'. The voltage regulator circuit 421 may provide a bias voltage to the voltage regulator node NDB' by adopting the high voltage VGH. The pull-up circuit 422 includes a transistor T4'. The first terminal of the transistor T4' is coupled to the high voltage VGH. The second terminal of the transistor T4' is coupled to the transmitting circuit 423. The control terminal of the transistor T4' is coupled to the voltage regulator node NDB'. The transmitting circuit 423 includes transistors T5' and T6'. The first terminal of the transistor T5' receives the scan signal SN[n]. The second terminal of the transistor T5' is coupled to the next-stage driving circuit DCN. The second terminal of the transistor T5' serves as the first output terminal of the determining circuit 420. The control terminal of the transistor T5' is coupled to the second terminal of the transistor T4'. The first terminal of the transistor T6' receives the light-emitting enable signal EM[n]. The second terminal of the transistor T6' is coupled to the next-stage driving circuit DCN. The second terminal of the transistor T6' serves as the second output terminal of the determining circuit 420. The control terminal of the transistor T6' is coupled to the second terminal of the transistor T4'. The pull-down circuit 424 includes a resistor R2. The resistor R2 is coupled between the control terminals of the transistors T5' and T6' and the low voltage VGL.

In this embodiment, the correction circuit 430 includes transistors T7', T8', T9', and T10'. The first terminal of the transistor T7' is coupled to the high voltage VGH. The control terminal of the transistor T7' receives the light-emitting enable signal EM[n]. The first terminal of the transistor T8' is coupled to the second terminal of the first detection transistor T7'. The second terminal of the transistor T8' is coupled to the second terminal of the transistor T5'. The control terminal of the transistor T8' receives the scan signal SN[n]. The first terminal of the transistor T9' is coupled to the high voltage VGH. The control terminal of the transistor T9' receives the light-emitting enable signal EM[n]. The first terminal of the transistor T10' is coupled to the second terminal of the first detection transistor T9'. The second terminal of the transistor T10' is coupled to the second terminal of the transistor T6'. The control terminal of the transistor T10' receives the scan signal SN[n].

Please refer to FIG. 2A, FIG. 6 and FIG. 7 at the same time. In this embodiment, based on the normal timing of the scan signal SN[n] and the light-emitting enable signal EM[n], the scan signal SN[n] and the light-emitting enable signal EM[n] do not have a low level simultaneously. The first detection transistor T1' and the second detection transistor T2' are not turned on simultaneously. The driving detection signal SD3 having the second level (low level) is not supplied to the voltage regulator node NDB'. Therefore, the level at the voltage regulator node NDB' is maintained at a high level. The transistor T4' will be turned off. The voltage values of the control terminals of the transistors T5' and T6' are pulled down to a low level by the pull-down circuit 424. Therefore, the transistor T5' is turned on to output the received scan signal SN[n] to the driving circuit DCN. The transistor T6' is turned on to output the received light-emitting enable signal EM[n] to the driving circuit DCN.

In addition, based on the normal timing of the scan signal SN[n] and the light-emitting enable signal EM[n], the scan signal SN[n] and the light-emitting enable signal EM[n] do not have a low level simultaneously. The transistors T7' and T8' are not turned on simultaneously. The transistors T9' and T10' are not turned on simultaneously. Therefore, the correction circuit 430 does not adopt the high voltage VGH to correct the levels at the second terminal of the transistor T5' and at the second terminal of the transistor T6' to a high level.

Please refer to FIG. 2C, FIG. 2D, FIG. 6 and FIG. 7 at the same time. In this embodiment, based on the abnormal timing of the scan signal SN[n] and the light-emitting enable signal EM[n], the scan signal SN[n] and the light-emitting enable signal EM[n] have a low level simultaneously. Therefore, the first detection transistor T1' and the second detection transistor T2' provide the driving detection signal SD3 having the second level to pull down the level at the voltage regulator node NDB'. The transistor T4' is turned on, and the high voltage VGH is adopted to set the level of the control terminals of the transistors T5' and T6' to a high level. Therefore, the transistors T5' and T6' are turned off. The transistor T5' is turned off and stops outputting the received scan signal SN[n] to the driving circuit DCN. The transistor T6' is turned off and stops outputting the received light-emitting enable signal EM[n] to the driving circuit DCN.

In addition, based on the abnormal timing of the scan signal SN[n] and the light-emitting enable signal EM[n]. The transistors T7', T8', T9', and T10' are turned on simultaneously. Therefore, the correction circuit 430 adopts the high voltage VGH to correct the levels at the second terminal of the transistor T5' and the second terminal of the transistor T6' to a high level.

In addition, the electronic device 400 further includes a reset circuit 440. The reset circuit 440 is coupled to the voltage regulator node NDB'. The reset circuit 440 resets the level at the voltage regulator node NDB' based on a specific timing. In this embodiment, the reset circuit 440 resets the level at the voltage regulator node NDB' based on the timing of the light-emitting enable signal EM[n]. The reset circuit 440 includes a transistor T3'. The first terminal of the transistor T3' receives the light-emitting enable signal EM[n]. The second terminal of the transistor T3' and the control terminal of the transistor T3' are coupled to the voltage regulator node NDB'. When the light-emitting enable signal EM[n] is at a high level, the reset circuit 440 will reset the level at the voltage regulator node NDB' to a high level to allow the pull-up circuit 422 to return to a normal operating state. In this embodiment, the first detection transistor T1', the second detection transistor T2', and the transistors T3' to T10' are respectively exemplified as, for example, P-type transistors, but the present disclosure is not limited thereto.

Figure 8:
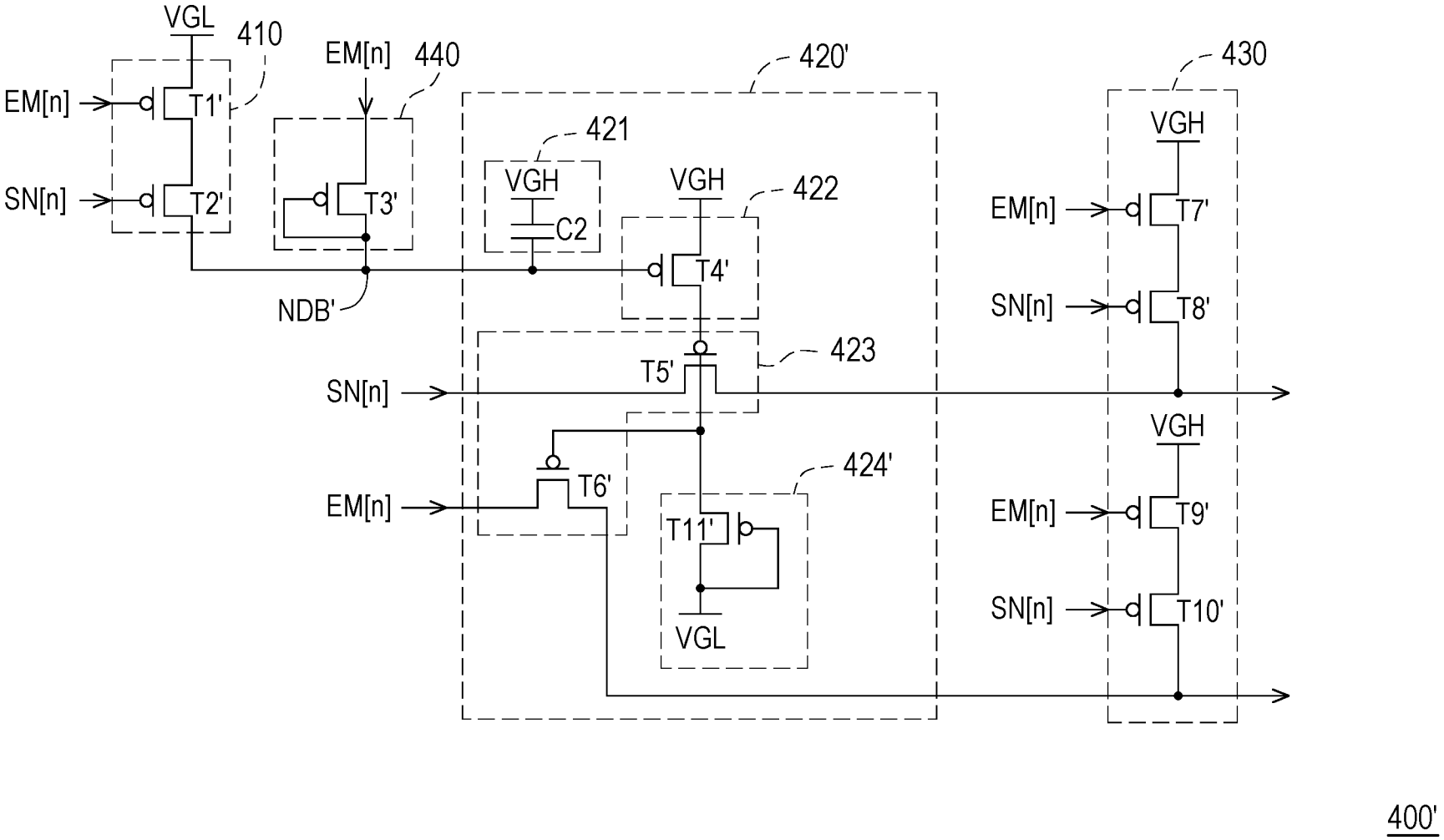
FIG. 8 is a second schematic circuit diagram of the detection circuit according to the second embodiment.

Please refer to FIG. 8, which is a second schematic circuit diagram of the electronic device according to the second embodiment. In this embodiment, the electronic device 400' includes a driving detection circuit 410, a determining circuit 420', a correction circuit 430, and a reset circuit 440. The implementations of the driving detection circuit 410, the correction circuit 430 and the reset circuit 440 are the same as the above-mentioned embodiments, so the details are not repeated here. The determining circuit 420' includes a voltage regulator circuit 421, a pull-up circuit 422, a transmitting circuit 423, and a pull-down circuit 424'. The implementations of the voltage regulator circuit 421, the pull-up circuit 422 and the transmitting circuit 423 are the same as those in the aforementioned embodiments, so the details are not repeated here. In this embodiment, the pull-down circuit 424' includes a transistor T11'. The first terminal of the transistor T11' is coupled to the control terminals of the transistors T5' and T6'. The second terminal of the transistor T11' and the control terminal of the transistor T11' are coupled to the low voltage VGL. The transistor T11' is configured to provide an equivalent resistor between the control terminals of the transistors T5' and T6' and the low voltage VGL. In this embodiment, the transistor T11' is exemplified as, for example, a P-type transistor, but the present disclosure is not limited thereto.

Figure 9:
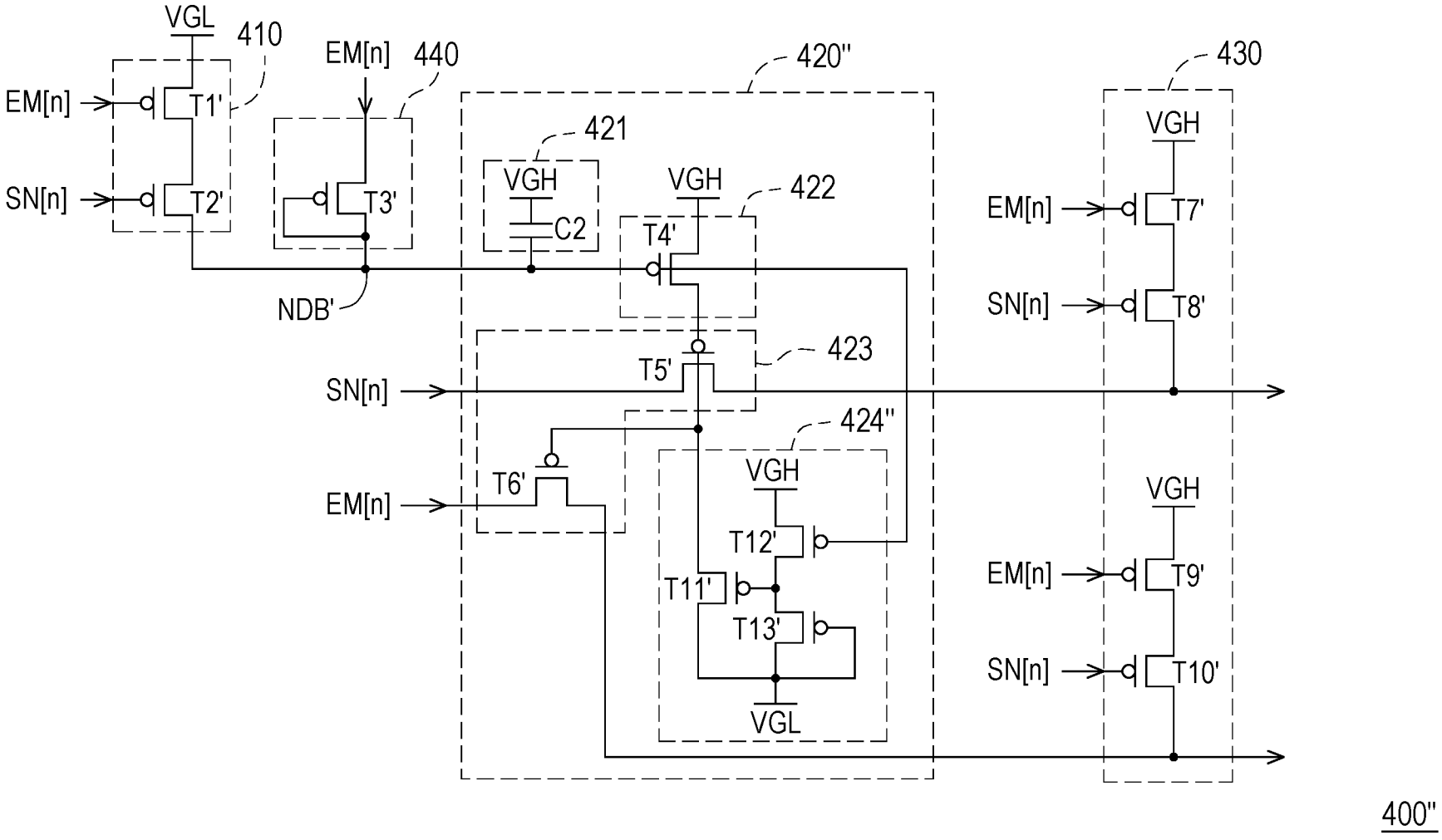
FIG. 9 is a third schematic circuit diagram of the detection circuit according to the second embodiment.

Please refer to FIG. 9, which is a third schematic circuit diagram of the electronic device according to the second embodiment. In this embodiment, the electronic device 400" includes a driving detection circuit 410, a determining circuit 420", a correction circuit 430, and a reset circuit 440. The implementations of the driving detection circuit 410, the correction circuit 430 and the reset circuit 440 are the same as the above-mentioned embodiments, so the details are not repeated here. The determining circuit 420" includes a voltage regulator circuit 421, a pull-up circuit 422, a transmitting circuit 423, and a pull-down circuit 424". The implementations of the voltage regulator circuit 421, the pull-up circuit 422 and the transmitting circuit 423 are the same as those in the aforementioned embodiments, so the details are not repeated here.

In this embodiment, the pull-down circuit 424" includes transistors T11', T12', and T13'. The first terminal of the transistor T11' is coupled to the control terminals of the transistors T5' and T6'. The second terminal of the transistor T11' is coupled to the low voltage VGL. The first terminal of the transistor T12' is coupled to the high voltage VGH. The second terminal of the transistor T12' is coupled to the control terminal of the transistor T11'. The control terminal of the transistor T12' is coupled to the voltage regulator node NDB'. The first terminal of the transistor T13' is coupled to the second terminal of the transistor T12'. The second terminal of the transistor T13' and the control terminal of the transistor T13' are coupled to the low voltage VGL. The transistor T13' is configured to provide an equivalent resistor between the control terminal of the transistor T11' and the low voltage VGL.

In this embodiment, when the level at the voltage regulator node NDB' is a low level, the transistors T4' and T12' are turned on. Therefore, the transistor T4' adopts the high voltage VGH to turn off the transistors T5' and T6'. Under the circumstances, the transistor T12' adopts the high voltage VGH to turn off the transistor T11'. Therefore, there is no leakage current between the control terminals of the transistors T5' and T6' and the low voltage VGL.

When the level at the voltage regulator node NDB' is high, the transistors T4' and T12' are turned off. The transistor T13' will pull down the level of the control terminal of the transistor T11' to a low level. The transistor T11' is turned on. Therefore, the transistor T5' is turned on to transmit the scan signal SN[n]. The transistor T6' is turned on to transmit the light-emitting enable signal EM[n]. In this embodiment, the transistors T11' to T13' are respectively exemplified as, for example, P-type transistors, but the present disclosure is not limited thereto.

Figure 10:
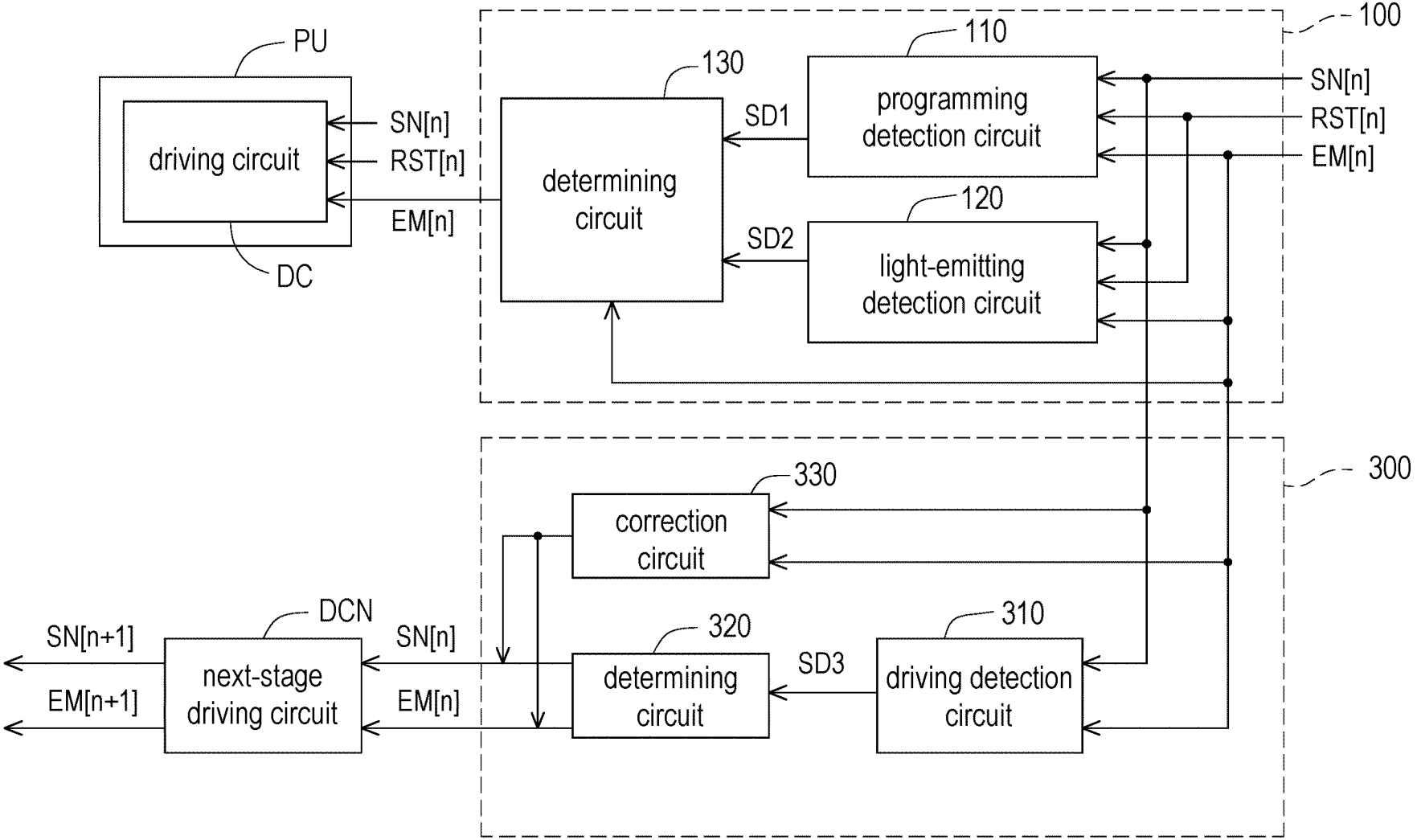
FIG. 10 is a schematic diagram of an electronic device according to a third embodiment of the present disclosure.

Please refer to FIG. 10, which is a schematic diagram of an electronic device according to a third embodiment of the present disclosure. In this embodiment, the electronic device 40 includes a pixel unit PU, a next-stage driving circuit DCN, and detection circuits 100 and 300. In this embodiment, the detection circuit 100 receives the scan signal SN[n], the reset signal RST[n] and the light-emitting enable signal EM[n] for the driving circuit DC. The detection circuit 100 provides the first detection signal SD1 in the first stage and the second detection signal SD2 in the second stage according to the scan signal SN[n], the reset signal RST[n] and the light-emitting enable signal EM[n]. The detection circuit 100 determines whether to output the light-emitting enable signal EM[n] to the driving circuit DC in the pixel unit PU according to the first detection signal SD1 and the second detection signal SD2. The detection circuit 300 receives the scan signal SN[n] and the light-emitting enable signal EM[n] for the driving circuit DC. The detection circuit 300 provides the driving detection signal SD3 according to the scan signal SN[n] and the light-emitting enable signal EM[n]. The detection circuit 300 outputs the scan signal SN[n] and the light-emitting enable signal EM[n] to the next-stage driving circuit DCN according to the driving detection signal SD3. The implementation details of the detection circuit 100 may be sufficiently taught in the embodiments of FIG. 1, FIG. 3, FIG. 4, and FIG. 5, so the details are not repeated here. The implementation details of the detection circuit 300 may be sufficiently taught in the embodiments of FIG. 6, FIG. 7, FIG. 8, and FIG. 9, so the details are not repeated here.

In some embodiments, the detection circuit 300 or a portion of the detection circuit 300 may be integrated into the detection circuit 100. In some embodiments, the detection circuit 100 or a portion of the detection circuit 100 may be integrated into the detection circuit 300.

Based on the above, the present disclosure provides various aspects of the electronic device. The electronic device detects a plurality of signals to provide at least one detection signal, and determines whether to output the signal to the driving circuit according to the at least one detection signal. In this way, the electronic device of the present disclosure may determine whether the plurality of signals are abnormal according to the at least one detection signal, and stop outputting the plurality of signals to the related driving circuit accordingly.

Finally, it should be noted that the above embodiments are only used to illustrate the technical solutions of the present disclosure, but not to limit them. Although the present disclosure has been described in detail with reference to the foregoing embodiments, those of ordinary skill in the art should understand that: The technical solutions described in the foregoing embodiments can still be modified, or some or all of the technical features thereof can be equivalently replaced; and these modifications or replacements do not make the essence of the corresponding technical solutions deviate from the scope of the technical solutions of the embodiments of the present disclosure.

What is claimed is:

1. An electronic device, comprising:

a detection circuit, comprising:

a programming detection circuit, configured to receives a scan signal, a reset signal and a light-emitting enable signal for a driving circuit, and provide a first detection signal in a first stage according to the scan signal, the reset signal and the light-emitting enable signal;

a light-emitting detection circuit, configured to receive the scan signal, the reset signal and the light-emitting enable signal, and provide a second detection signal in a second stage according to the scan signal, the reset signal and the light-emitting enable signal; and a determining circuit, coupled to the programming detection circuit and the light-emitting detection circuit, configured to determine whether to output the light-emitting enable signal to the driving circuit according to the first detection signal and the second detection signal.

2. The electronic device according to claim 1, wherein:

the driving circuit is a pixel driving circuit provided in a pixel unit, the first stage is a data input stage for the driving circuit, and the second stage is a light-emitting stage for the driving circuit.

3. The electronic device according to claim 1, wherein:

the determining circuit determines whether an abnormality occurs in the first stage and the second stage according to the first detection signal and the second detection signal, and when it is determined that the abnormality occurs in at least one of the first stage and the second stage, the determining circuit stops outputting the light-emitting enable signal to the driving circuit.

4. The electronic device according to claim 3, wherein when the determining circuit determines that the abnormality does not occur in the first stage and the second stage according to the first detection signal and the second detection signal, the determining circuit outputs the light-emitting enable signal to the driving circuit.

5. The electronic device according to claim 1, wherein the programming detection circuit comprises:

a first detection transistor, wherein a first terminal of the first detection transistor and a control terminal of the first detection transistor receive the reset signal, wherein a second terminal of the first detection transistor is coupled to a voltage regulator node; and a second detection transistor, wherein a first terminal of the second detection transistor is coupled to the voltage regulator node, a second terminal of the second detection transistor receives the light-emitting enable signal, and a control terminal of the second detection transistor receives the scan signal.

6. The electronic device according to claim 5, wherein the light-emitting detection circuit comprises:

a third detection transistor, wherein a first terminal of the third detection transistor is coupled to the voltage regulator node, a control terminal of the third detection transistor receives the scan signal;

a fourth detection transistor, wherein a first terminal of the fourth detection transistor is coupled to the voltage regulator node, a control terminal of the fourth detection transistor receives the reset signal; and a fifth detection transistor, wherein a first terminal of the fifth detection transistor is coupled to a second terminal of the third detection transistor and a second terminal of the fourth detection transistor, a second terminal of the fifth detection transistor is coupled to a low gate voltage, and a control terminal of the fifth detection transistor receives the light-emitting enable signal.

7. The electronic device according to claim 5, wherein the determining circuit comprises:

a voltage regulator circuit, coupled to the voltage regulator node, configured to provide a bias voltage to the voltage regulator node;

a pull-up circuit, coupled to the voltage regulator node;

a transmitting circuit, coupled to the pull-up circuit; and a pull-down circuit, coupled to the transmitting circuit, wherein the pull-up circuit is disabled in response to a first level at the voltage regulator node, so that the transmitting circuit is turned on by the pull-down circuit and outputs the light-emitting enable signal to the driving circuit, and wherein the pull-up circuit is enabled in response to a second level at the voltage regulator node, so that the transmitting circuit is turned off and stops outputting the light-emitting enable signal to the driving circuit.

8. The electronic device according to claim 7, wherein the voltage regulator circuit comprises:

a capacitor, coupled between a high voltage and the voltage regulator node.

9. The electronic device according to claim 7, wherein the pull-up circuit comprises:

a pull-up transistor, wherein a first terminal of the pull-up transistor is coupled to a high voltage, and a second terminal of the pull-up transistor is coupled to the transmitting circuit, wherein a control terminal of the pull-up transistor is coupled to the voltage regulator node and the voltage regulator circuit.

10. The electronic device according to claim 9, wherein the transmitting circuit comprises:

a first transmitting transistor, wherein a first terminal of the first transmitting transistor is coupled to a second terminal of the pull-up transistor, a control terminal of the first transmitting transistor is configured to receive the light-emitting enable signal; and a second transmitting transistor, wherein a first terminal of the second transmitting transistor is coupled to a control terminal of the first transmitting transistor, a second terminal of the second transmitting transistor is coupled to the first terminal of the first transmitting transistor and serves as an output terminal of the determining circuit, and a control terminal of the second transmitting transistor is coupled to a second terminal of the first transmitting transistor.

11. The electronic device according to claim 10, wherein the pull-down circuit comprises:

a resistor, coupled between the control terminal of the second transmitting transistor and a low voltage.

12. The electronic device according to claim 10, wherein the pull-down circuit comprises:

a pull-down transistor, wherein a first terminal of the pull-down transistor is coupled to the control terminal of the second transmitting transistor, and a second terminal of the pull-down transistor and a control terminal of the pull-down transistor are coupled to a low voltage.

13. The electronic device according to claim 10, wherein the pull-down circuit comprises:

a first pull-down transistor, wherein a first terminal of the first pull-down transistor is coupled to the control terminal of the second transmitting transistor, a second terminal of the first pull-down transistor is coupled to a low voltage;

a second pull-down transistor, wherein a first terminal of the second pull-down transistor is coupled to the high voltage, wherein a second terminal of the second pull-down transistor is coupled to a control terminal of the first pull-down transistor, a control terminal of the second pull-down transistor is coupled to the voltage regulator node; and a third pull-down transistor, wherein a first terminal of the third pull-down transistor is coupled to the second terminal of the second pull-down transistor, a second terminal of the third pull-down transistor and a control terminal of the third pull-down transistor are coupled to a low voltage.

14. An electronic device, comprising:

a next-stage driving circuit; and a detection circuit, comprising:

a driving detection circuit, configured to receive a scan signal and a light-emitting enable signal for a driving circuit, and to provide a driving detection signal according to the scan signal and the light-emitting enable signal;

a determining circuit, coupled to the driving detection circuit, configured to determine whether to output the scan signal and the light-emitting enable signal to the next-stage driving circuit according to the driving detection signal; and a correction circuit, coupled to the determining circuit, configured to correct a level of an output of the determining circuit according to the scan signal and the light-emitting enable signal.

15. The electronic device according to claim 14, wherein:

the driving circuit is a pixel driving circuit provided in a pixel unit, and the next-stage driving circuit is a gate driving circuit.

16. The electronic device according to claim 14, wherein:

the determining circuit determines whether an abnormality occurs to the scan signal and the light-emitting enable signal according to the driving detection signal, and when it is determined that the abnormality occurs to at least one of the scan signal and the light-emitting enable signal, the determining circuit stops outputting the scan signal and the light-emitting enable signal to the next-stage driving circuit, and the correction circuit corrects the level of the output of the determining circuit.

17. The electronic device according to claim 14, wherein the driving detection circuit comprises:

a first detection transistor, wherein a first terminal of the first detection transistor is coupled to a low voltage, a control terminal of the first detection transistor receives the light-emitting enable signal; and a second detection transistor, wherein a first terminal of the second detection transistor is coupled to a second terminal of the first detection transistor, a second terminal of the second detection transistor is coupled to a voltage regulator node, and a control terminal of the second detection transistor receives the scan signal.

18. The electronic device according to claim 17, wherein the determining circuit comprises:

a voltage regulator circuit, coupled to the voltage regulator node, configured to provide a bias voltage to the voltage regulator node;

a pull-up circuit, coupled to the voltage regulator node;

a transmitting circuit, coupled to the pull-up circuit; and a pull-down circuit, coupled to the transmitting circuit, wherein the pull-up circuit is disabled in response to a first level at the voltage regulator node, so that the transmitting circuit is turned on by the pull-down circuit and outputs the light-emitting enable signal to the next-stage driving circuit, and wherein the pull-up circuit is enabled in response to a second level at the voltage regulator node, so that the transmitting circuit is turned off and stops outputting the light-emitting enable signal to the next-stage driving circuit.

19. The electronic device according to claim 18, further comprising:

a reset circuit, coupled to the voltage regulator node, resetting a level at the voltage regulator node based on a timing of the light-emitting enable signal.

20. The electronic device according to claim 18, wherein the reset circuit comprises:

a reset transistor, wherein a first terminal of the reset transistor receives the light-emitting enable signal, a second terminal of the reset transistor and a control terminal of the reset transistor are coupled to the voltage regulator node.

* * * * *